US009157615B2

(12) United States Patent
Matsushima

(10) Patent No.: US 9,157,615 B2
(45) Date of Patent: Oct. 13, 2015

(54) LIGHTING DEVICE

(71) Applicant: PANASONIC CORPORATION, Osaka (JP)

(72) Inventor: Megumi Matsushima, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 132 days.

(21) Appl. No.: 13/751,527

(22) Filed: Jan. 28, 2013

(65) Prior Publication Data

US 2013/0201687 A1 Aug. 8, 2013

(30) Foreign Application Priority Data

Feb. 3, 2012 (JP) ..... 2012-021827

(51) Int. Cl.

| | |
|---|---|
| ***F21S 8/00*** | (2006.01) |
| ***F21V 21/04*** | (2006.01) |
| ***F21S 8/04*** | (2006.01) |
| ***F21S 8/02*** | (2006.01) |
| ***F21S 2/00*** | (2006.01) |
| ***F21V 17/16*** | (2006.01) |
| ***F21V 3/04*** | (2006.01) |
| *F21V 25/12* | (2006.01) |

(52) U.S. Cl.

CPC ..... *F21V 21/044* (2013.01); *F21S 2/00* (2013.01); *F21S 8/02* (2013.01); *F21S 8/026* (2013.01); *F21S 8/046* (2013.01); *F21V 3/049* (2013.01); *F21V 17/164* (2013.01); *F21V 25/12* (2013.01)

(58) Field of Classification Search

CPC ..... F21S 8/026; F21S 8/046; F21S 2/00; F21V 21/04; F21V 21/044

USPC ..... 362/147, 374, 388, 240, 235, 238, 362/249.1, 249.02

See application file for complete search history.

(56) References Cited

U.S. PATENT DOCUMENTS

| | | | | |
|---|---|---|---|---|
| 5,777,857 | A * | 7/1998 | Degelmann | 362/150 |
| 8,714,787 | B2 * | 5/2014 | McGehee et al. | 362/388 |
| 2008/0212330 | A1 * | 9/2008 | Hartmann et al. | 362/311 |
| 2009/0257219 | A1 * | 10/2009 | Doubek | 362/147 |

(Continued)

FOREIGN PATENT DOCUMENTS

| | | |
|---|---|---|
| DE | 202008004786 | 7/2008 |
| JP | 2009-170249 | 7/2009 |

(Continued)

OTHER PUBLICATIONS

Search report from E.P.O., mail date is Dec. 1, 2014.

*Primary Examiner* — Peggy Neils

(74) *Attorney, Agent, or Firm* — Greenblum & Bernstein, P.L.C.

(57) ABSTRACT

A lighting device includes a device body attached to an installation surface, one or more surface light-emitting modules held in the device body, and a cover held in the device body in an opposing relationship with light-emitting surfaces of the surface light-emitting modules. Each of the surface light-emitting modules includes a light-emitting unit having a light-emitting body and a base unit fixed to the device body and configured to removably hold the light-emitting unit by an elastic force. At least portions of the cover facing the light-emitting surfaces of the surface light-emitting modules are made of a light-transmitting material. The cover is held in the device body by a force stronger than the elastic force.

3 Claims, 12 Drawing Sheets

(56) References Cited

U.S. PATENT DOCUMENTS

| | | | | |
|---|---|---|---|---|
| 2011/0305016 | A1* | 12/2011 | Maeers | 362/235 |
| 2013/0070455 | A1* | 3/2013 | Tsui et al. | 362/235 |

FOREIGN PATENT DOCUMENTS

| | | |
|---|---|---|
| JP | 2011-243461 | 12/2011 |
| WO | 2009/052172 | 4/2009 |

* cited by examiner

LIGHTING DEVICE

FIELD OF THE INVENTION

The present invention relates to a lighting device.

BACKGROUND OF THE INVENTION

In recent years, as an illumination-purpose light source, attention is paid to a surface light-emitting source using an organic EL (electroluminescence) element. For example, Japanese Patent Application Publication No. 2011-243461 discloses a lighting device using an organic EL panel as a surface light-emitting source.

In the conventional example of Japanese Patent Application Publication No. 2011-243461, a surface light-emitting module having an organic EL panel and an accommodation portion for accommodating the surface light-emitting module with little clearance are arranged in a device body. A positive power-feeding terminal and a negative power-feeding terminal connected to an external power supply through an electric circuit are provided in two opposing sides of a bottom surface of the accommodation portion. Protrusions engageable with locking holes formed at the opposite ends of lateral surfaces of the surface light-emitting module are formed on two opposing inner surfaces of the accommodation portion. A hook-shaped locking piece capable of moving into and out of the accommodation portion is provided on one of the two opposing inner surfaces of the accommodation portion. The locking piece is normally biased by a spring in such a direction as to protrude from one inner surface of the accommodation portion. An operation piece for displacing the locking piece against the biasing force of the spring and retracting the locking piece inward of the inner surface of the accommodation portion is arranged around the accommodation portion.

Accordingly, if the protrusions arranged inside the accommodation portion come into engagement with the locking holes formed in the arbitrary corners of the surface light-emitting module, the surface light-emitting module is connected to the device body through the protrusions and can rotate about the protrusions as a rotation axis. Thereafter, if the surface light-emitting module is rotated toward the accommodation portion, the other surface of the surface light-emitting module makes contact with the locking piece. If the surface light-emitting module is further rotated toward the accommodation portion, the locking piece is pushed inward of the inner surface of the accommodation portion against the biasing force of the spring, whereby the surface light-emitting module is accommodated within the accommodation portion. A locking groove for receiving the locking piece is formed on each of the lateral surfaces of the surface light-emitting module. If the surface light-emitting module is accommodated within the accommodation portion in this manner, the locking piece normally biased by the spring protrudes again into the accommodation portion and comes into the locking groove. As a consequence, the surface light-emitting module is held by the protrusions at one side and by the locking piece at the other side, whereby the surface light-emitting module is fixed inside the accommodation portion.

When removing the surface light-emitting module from the device body, the operation piece is slid and the locking piece is retracted against the biasing force of the spring. Thus the surface light-emitting module is detached from the locking groove. In case where the device body is attached to a ceiling, the surface light-emitting module is rotated downward by the weight thereof. As a result, a gap is generated between the surface light-emitting module and the accommodation portion, whereby the surface light-emitting module can be removed from the device body.

In the conventional example of Japanese Patent Application Publication No. 2011-243461, if a strong vibration is applied to the device body due to an earthquake or other causes, there is a possibility that the surface light-emitting module is moved against the biasing force of the spring and the locking piece is disengaged from the locking groove. In the event that the locking piece is disengaged from the locking groove, the surface light-emitting module may possibly be dropped from the accommodation portion of the device body.

SUMMARY OF THE INVENTION

In view of the above, the present invention provides a lighting device capable of making a surface light-emitting module hard to drop from a device body.

In accordance with an embodiment of the present invention, there is a provided a lighting device, including: a device body attached to an installation surface; one or more surface light-emitting modules held in the device body; and a cover held in the device body in an opposing relationship with light-emitting surfaces of the surface light-emitting modules, wherein each of the surface light-emitting modules includes a light-emitting unit having a light-emitting body and a base unit fixed to the device body and configured to removably hold the light-emitting unit by an elastic force, and at least portions of the cover facing the light-emitting surfaces of the surface light-emitting modules are made of a light-transmitting material, the cover being held in the device body by a force stronger than the elastic force.

The cover may be held in the device body in a spaced-apart relationship with the light-emitting surfaces of the surface light-emitting modules.

The surface light-emitting modules may be held in the device body such that the light-emitting surfaces are arranged with gaps therebetween, the cover being formed such that regions corresponding to the gaps have a light transmittance smaller than that of regions corresponding to the light-emitting surfaces.

The lighting device according to the present invention includes the cover opposed to the light-emitting surface of the surface light-emitting module and held in the device body with a force stronger than an elastic force by which the light-emitting unit is held in the base unit. Therefore, even if the light-emitting unit of the surface light-emitting module is not held in the base unit, the surface light-emitting module (the light-emitting unit) is hard to drop from the device body.

BRIEF DESCRIPTION OF THE DRAWINGS

The objects and features of the present invention will become apparent from the following description of embodiments, given in conjunction with the accompanying drawings, in which:

FIGS. 6A and 68 are bottom and top views showing a lighting device according to a third embodiment of the present invention;

DETAILED DESCRIPTION OF THE PREFERRED EMBODIMENTS

Embodiments of a lighting device according to the present invention will now be described in detail with reference to the accompanying drawings which form a part hereof. Description on a surface light-emitting module 1 commonly used in the respective embodiments will precede description on the embodiments of the lighting device.

Figure 9:
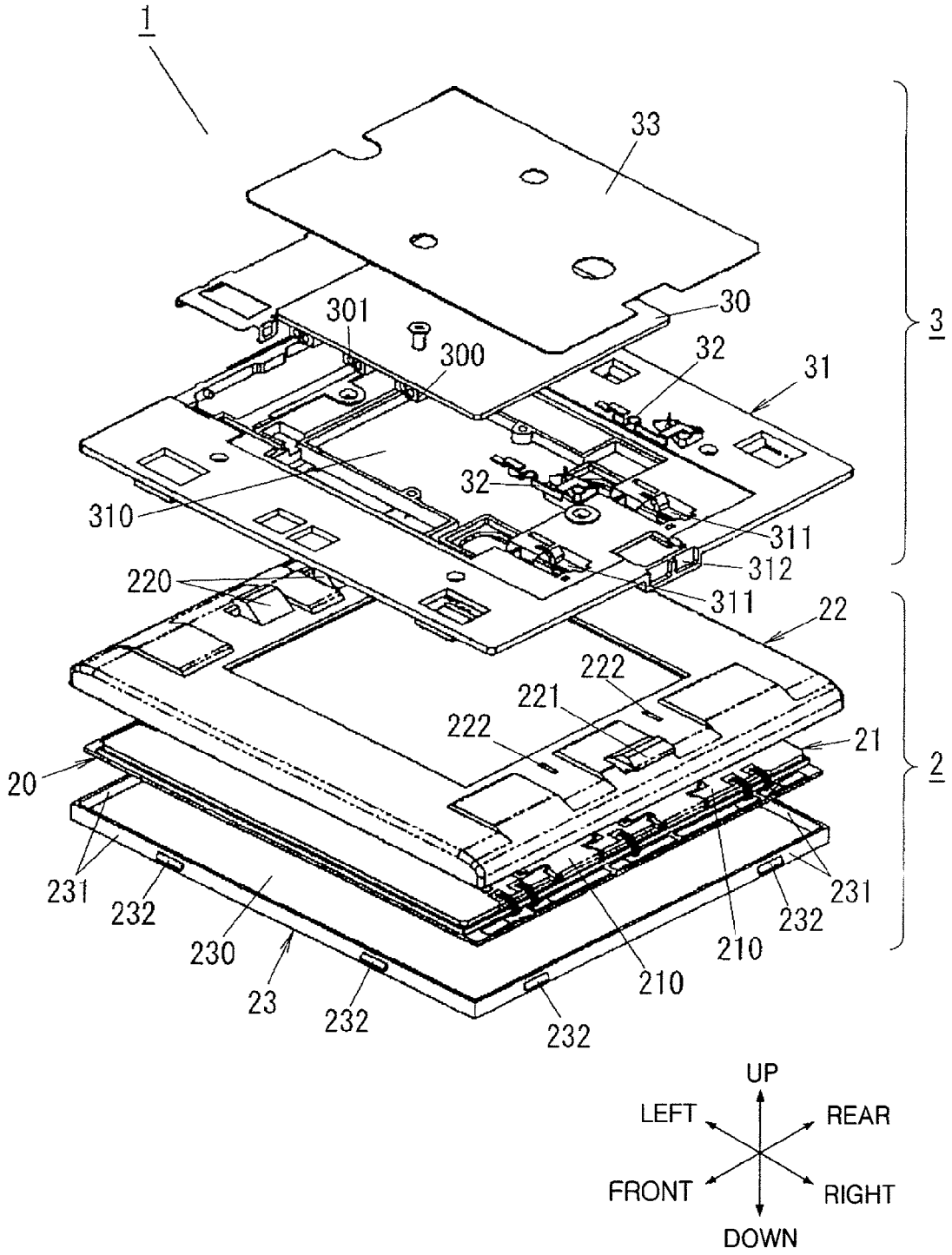
FIG. 9 is an exploded perspective view showing a surface light-emitting module employed in the lighting device according to the first to fourth embodiments of the present invention.

As shown in FIG. 9, the surface light-emitting module 1 includes an light-emitting unit 2 provided with a light-emitting body 20, a wiring substrate 21, a case body 22, a case cover 23 and so forth, and a base unit 3 for removably holding the light-emitting unit 2. In the following description, the up-down direction, the left-right direction and the front-rear direction are defined on the basis of FIG. 9.

The light-emitting body 20 is made up of an organic electroluminescence element formed on a flat panel. The wiring substrate 21 includes a pair of terminal portions 210 arranged on the upper surface of the wiring substrate 21 facing the case body 22 and a conductive pattern (not shown) for connecting electrodes (positive and negative electrodes) of the light-emitting body 20 to the terminal portions 210. The wiring substrate 21 is bonded to the non-light-emitting surface (the upper surface) of the light-emitting body 20 by a tape whose opposite surfaces are applied with an adhesive agent.

The case body 22 is formed into a substantially flat rectangular box-like shape and is provided with a recess portion in the central region thereof. A pair of first engaging portions 220 is arranged at the left end region of the upper surface of the case body 22. A second engaging portion 221 is arranged in the right end region of the upper surface of the case body 22. The first engaging portions 220 are formed into a hook-like shape so as to protrude upward and leftward from the upper surface of the case body 22. In the right end region of the upper surface of the case body 22, rectangular through-holes 222 are formed at the front and rear sides of the second engaging portion 221.

The case cover 23 is made of a light-transmitting synthetic resin material and is formed into a rectangular box-like shape so as to have an open upper surface. The case cover 23 includes a rectangular bottom plate 230 facing the light-emitting surface of the light-emitting body 20 and a side wall 231 protruding upward from the peripheral edge of the bottom plate 230. The bottom plate 230 and the side wall 231 are one-piece formed with each other. Two engaging lugs 232 protrude from each of the outer surfaces of the side wall 231.

On the other hand, engaging grooves (not shown) for engagement with the engaging lugs 232 of the case cover 23 are formed on the inner circumferential surface of the side wall of the case body 22. The case body 22 is covered on the case cover 23 in which the light-emitting body 20 and the wiring substrate 21 are mounted on the bottom plate 230. The engaging lugs 232 of the case cover 23 engage with the engaging grooves of the case body 22, whereby the case body 22 and the case cover 23 are coupled to each other. Portions of the terminal portions 210 of the wiring substrate 21 (the plate-like portions of the terminal portions 210 protruding upward) are inserted into the through-holes 222 formed in the case body 22. The assembly of the case body 22 and the case cover 23 is called a case.

The base unit 3 includes a circuit board 30, a housing 31, terminal reception portions 32, a protection cover 33 and the like. Mounted on the circuit board 30 are an electronic circuit for supplying DC power to the light-emitting body 20 and for adjusting, in response to a dimming signal supplied from the outside, the amount of the DC power supplied to the light-emitting body 20, a power feeding connector 300 connected to an external power supply and a signal input connector 301 through which the dimming signal is inputted. The power feeding connector 300 and the signal input connector 301 are connected to the electronic circuit by a conductive pattern (not shown) formed on the circuit board 30.

Each of the terminal reception portions 32 is formed by bending a band-like metal plate. One end portions (the left end portions) of the terminal reception portions 32 are fixed to the circuit board 30 and the other end portions (the right end portions) of the terminal reception portions 32 makes electric contact with some portions of the terminal portions 210 of the wiring substrate 21, which are inserted into the through-holes 222 of the case body 22. In other words, the electronic circuit mounted on the circuit board 30 is electrically connected to the light-emitting body 20 through the terminal reception portions 32 and the terminal portions 210.

The housing 31 is formed into a substantially rectangular plate-like shape. A recess portion 310 for accommodating the circuit board 30 is formed in the central region of the housing 31. A pair of holes 311 into which some portions of the terminal portions 210 protruding from the through-holes 222 of the case body 22 are respectively inserted are formed in the right end portion of the housing 31. A pair of first engaged portions (not shown) engaging with the first engaging portions 220 of the case body 22 are formed on the lower surface of the left end portion of the housing 31. A second engaged portion 312 engaging with the second engaging portion 221 of the case body 22 is formed on the lower surface of the right end portion of the housing 31. The circuit board 30 is accommodated within the recess portion 310 of the housing 31 and is fixed to the housing 31 by screws. The protection cover 33 is formed into a rectangular plate-like shape and is fixed to the upper surface of the housing 31 so as to cover the circuit board 30 accommodated within the recess portion 310.

Figure 10:
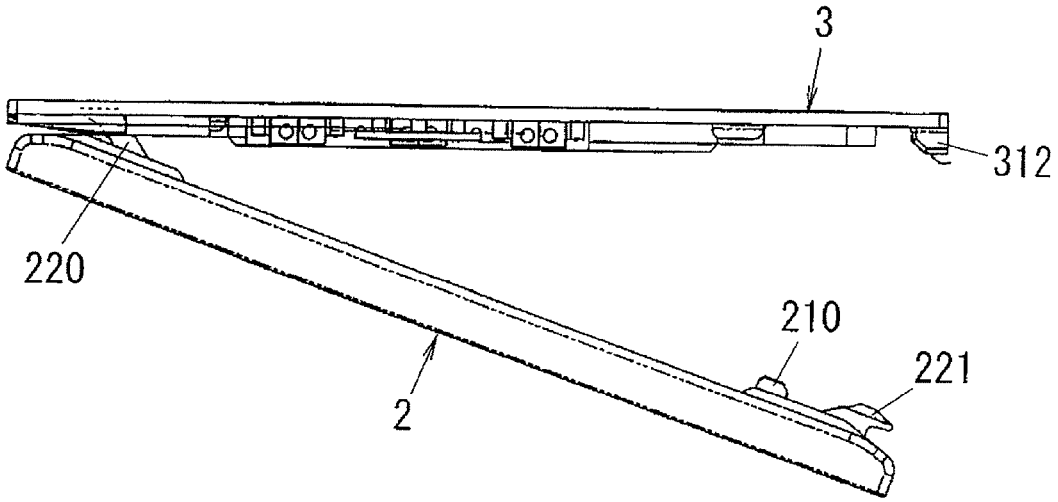
FIG. 10 is a side view of the surface light-emitting module under a mounting process.

Finally, an order of attaching the light-emitting unit 2 to the base unit 3 will be described with reference to FIG. 10. As will be described below, the base unit 3 is attached in advance to the device body of the lighting device.

First, the first engaging portions 220 are brought into engagement with the first engaged portions of the base unit 3. Thereafter, the light-emitting unit 2 is slid outward (leftward) with respect to the base unit 3. Subsequently, the light-emitting unit 2 is rotated toward the base unit 3 about the first engaging portions 220 into a position where the second engaging portion 221 and the second engaged portion 312 face each other in the left-right direction. If a leftward pressing force applied to the light-emitting unit 2 is eliminated, the light-emitting unit 2 is slid inward (rightward) by the elastic force of the first engaging portions 220, whereby the second engaging portion 221 and the second engaged portion 312 come into engagement with each other. In other words, the light-emitting unit 2 is held in the base unit 3 by the elastic forces of the first engaging portions 220 and the second engaging portion 221. If the light-emitting unit 2 is slid outward and if the second engaging portion 221 and the second engaged portion 312 are disengaged from each other, the light-emitting unit 2 can be removed from the base unit 3.

(First Embodiment)

Figure 1A:
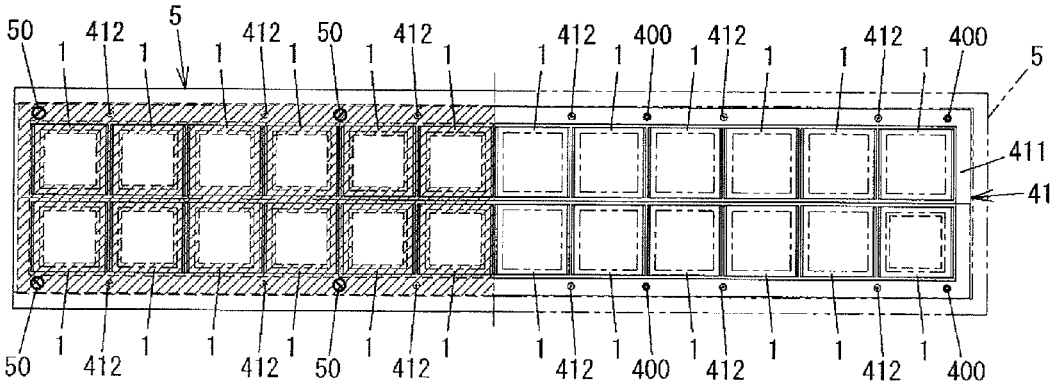
FIGS. 1A, 1B and 1C are bottom, side and end views showing a lighting device according to a first embodiment of the present invention.
Figure 1B:
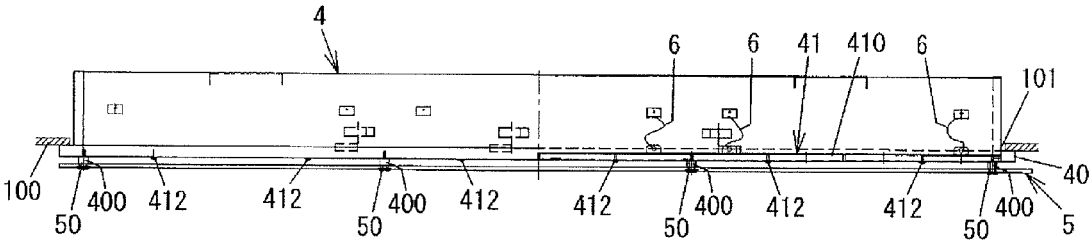
Figure 1C:
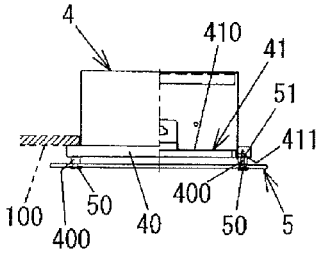

Referring to FIGS. 1A to 1C, the lighting device of the present embodiment includes a device body 4 embedded in a ceiling, a plurality of (twenty four, in the illustrated embodiment) surface light-emitting modules 1 held in the device body 4 and a cover 5 held in the device body 4.

The device body 4 is made of a metallic material such as a steel plate or the like and is formed into an elongated rectangular box-like shape to have an open lower surface. A frame portion 40 having an L-like cross-sectional shape is formed along the entire circumference of the lower end of the device body 4.

An attachment plate 41 to which the base units 3 of the surface light-emitting modules 1 are attached is accommodated within the device body 4. The attachment plate 41 includes a rectangular flat plate-like attachment portion 410 facing the lower surface (the open surface) of the device body 4 and a flange portion 411 formed along the entire circumference of the attachment plate 41 to protrude outward from the peripheral edge of the attachment portion 410. The attachment portion 410 and the flange portion 411 are one-piece formed with each other. The flange portion 411 is fixed to the frame portion 40 of the device body 4 by fixing screws 412. The lower surface (installation surface) of the attachment portion 410 is positioned higher than the lower surface of the flange portion 411 by a distance substantially equal to the thickness of the surface light-emitting modules 1. Accordingly, the lower surfaces of the surface light-emitting modules 1 attached to the attachment portion 410 (the surface of the case cover 23) is substantially flush with the lower surface of the flange portion 411.

The base units 3 of the surface light-emitting modules 1 are screw-fixed to the lower surface of the attachment portion 410 of the attachment plate 41 so that twelve base units 3 are arranged along the longitudinal direction and two base units 3 are arranged along the transverse direction. A space (gap) is provided between the two base units 3 arranged along the transverse direction. The space allows the light-emitting units 2 to slide with respect to the base units 3 when the light-emitting units 2 are mounted to the base units 3.

The cover 5 is made of a light-transmitting synthetic resin such as a acryl resin or a polycarbonate resin and is formed into an elongated rectangular flat plate-like shape. The longitudinal and transverse dimensions of the cover 5 are larger than the longitudinal and transverse dimensions of the device body 4 including the frame portion 40. Four bolt insertion holes (not shown) are formed in each of the transverse opposite end portions of the cover 5 and are arranged at a regular interval along the longitudinal direction of the cover 5.

On the other hand, four boss portions 400 are formed in each of the transverse opposite end portions of the frame portion 40 of the device body 4 and are arranged at a regular interval along the longitudinal direction of the device body 4 so as to protrude downward. The interval of the boss portions 400 is equal to the interval of the bolt insertion holes formed in the cover 5. The boss portions 400 have a cylindrical shape. Bolts 50 passing through the bolt insertion holes of the cover 5 are inserted into the boss portions 400.

Next, description will be made on an installation order of embedding the lighting device to the ceiling. First, a rectangular embedment hole 101 is formed in the ceiling 100 as an installation surface.

Subsequently, a pair of hanger bolts (not shown) arranged at the rear side of the ceiling is inserted into the bolt insertion holes (not shown) formed in the bottom surface (the upper surface) of the device body 4. Nuts (not shown) are tightened to the hanger bolts inserted into the bolt insertion holes, whereby the device body 4 is attached to the hanger bolts. At this time, the frame portion 40 of the device body 4 is brought into contact with the ceiling 100 from below.

In this regard, a plurality of strings 6 is tied at one ends to the inner surface of the device body 4. The other ends of the strings 6 are tied to the attachment plate 41. Thus the attachment plate 41 to which the base units 3 of the surface light-emitting modules 1 are attached is suspended from the device body 4 by the strings 6. In the state that the attachment plate 41 is suspended from the device body 4, power supply lines (not shown) and dimming signal lines (not shown) are respectively connected to the power feeding connectors 300 and the signal input connectors 301 mounted to the circuit boards 30 of the base units 3.

Subsequently, the attachment portion 410 of the attachment plate 41 is accommodated within the device body 4. The flange portion 411 is fixed to the frame portion 40 of the device body 4 by the fixing screws 412. Through-holes (not shown) into which the boss portions 400 of the frame portion 40 are inserted are formed in the flange portion 411.

After the attachment plate 41 is fixed to the device body 4, the light-emitting units 2 are mounted to the base units 3 attached to the attachment plate 41. As a result of the light-emitting units 2 being mounted to the base units 3, the surface light-emitting modules 1 are held in the device body 4.

Finally, the cover 5 is attached to the lower surface of the device body 4. In other words, the bolts 50 passing through the bolt insertion holes of the cover 5 are inserted into the respective boss portions 400 of the frame portion 40 and are tightened to the nuts 51 arranged inside the frame portion 40, whereby the cover 5 is held in the device body 4.

In the lighting device embedded in the ceiling 100 in the aforementioned manner, if a strong vibration is applied to the surface light-emitting modules 1 due to an earthquake or the like, there is a possibility that the light-emitting units 2 are slid and that the second engaging portion 221 and the second engaged portion 312 are disengaged from each other. In the lighting device of the present embodiment, however, the cover 5 is arranged below the device body 4. Therefore, even if the second engaging portion 221 and the second engaged portion 312 are disengaged from each other, the light-emitting units 2 come into contact with the cover 5. Thus the light-emitting units 2 are hard to drop from the base units 3 (the device body 4). Since the cover 5 is screw-fixed to the frame portion 40 of the device body 4, the holding force by which the cover 5 is held in the device body 4 is stronger than the holding force by which the surface light-emitting modules 1 are held in the device body 4 (i.e., the holding force by which the light-emitting units 2 are held in the base units 3). For that reason, it is usually unlikely that the cover 5 drops from the device body 4 before the second engaging portions 221 of the light-emitting units 2 are disengaged from the second engaged portions 312 of the base units 3.

In the surface light-emitting modules 1, non-light-emitting regions (the regions outside double-dot chain lines in FIG. 1A) exist around the light-emitting surfaces. Therefore, the light-emitting surfaces are arranged side by side in a spaced-apart relationship, thereby marring the outward appearance of the lighting device. In the present embodiment, for example, the boss portions 400 are installed to protrude from the frame portion 40 of the device body 4. Thus the cover 5 can be held in the device body 4 in a spaced-apart relationship with the lower surface of the device body 4 (i.e., the light-emitting surfaces of the surface light-emitting modules 1). Accordingly, a portion of the light emitted from the surface light-emitting modules 1 is repeatedly reflected between the upper surface of the cover 5 and the light-emitting surfaces of the surface light-emitting modules 1. As a result, as compared with a case where the lower surface of the cover 5 makes contact with the light-emitting surfaces of the surface light-emitting modules 1, the boundary between the light-emitting surfaces and the non-light-emitting regions is hardly visible. This makes it possible to ameliorate the outward appearance of the lighting device.

The cover 5 may be formed such that the light transmittance of the regions between the light-emitting surfaces of the adjoining surface light-emitting modules 1, i.e., the light transmittance of the regions of the cover 5 facing the non-light-emitting regions, becomes smaller than the light transmittance of the regions of the cover 5 facing the light-emitting surfaces. For example, as shown in FIG. 1A, the hatched region of the front surface of the cover 5 may be coated with paint or may be formed to have irregularities, which makes it possible to reduce the light transmittance. In the configuration shown in FIG. 1A, the light transmittance of the regions of the cover 5 facing the peripheral edge regions of the light-emitting surfaces of the surface light-emitting modules 1 is made smaller. However, the light transmittance of the regions of the cover 5 facing the light-emitting surfaces of the surface light-emitting modules 1 may not be reduced.

If the cover 5 is formed in the aforementioned manner such that the light transmittance of the regions of the cover 5 facing the non-light-emitting regions becomes smaller than the light transmittance of the regions of the cover 5 facing the light-emitting surfaces, the boundary between the light-emitting surfaces and the non-light-emitting regions is hardly visible as compared with a case where the light transmittance of the whole regions of the cover 5 is uniform. This makes it possible to ameliorate the outward appearance of the lighting device.

Figure 2:
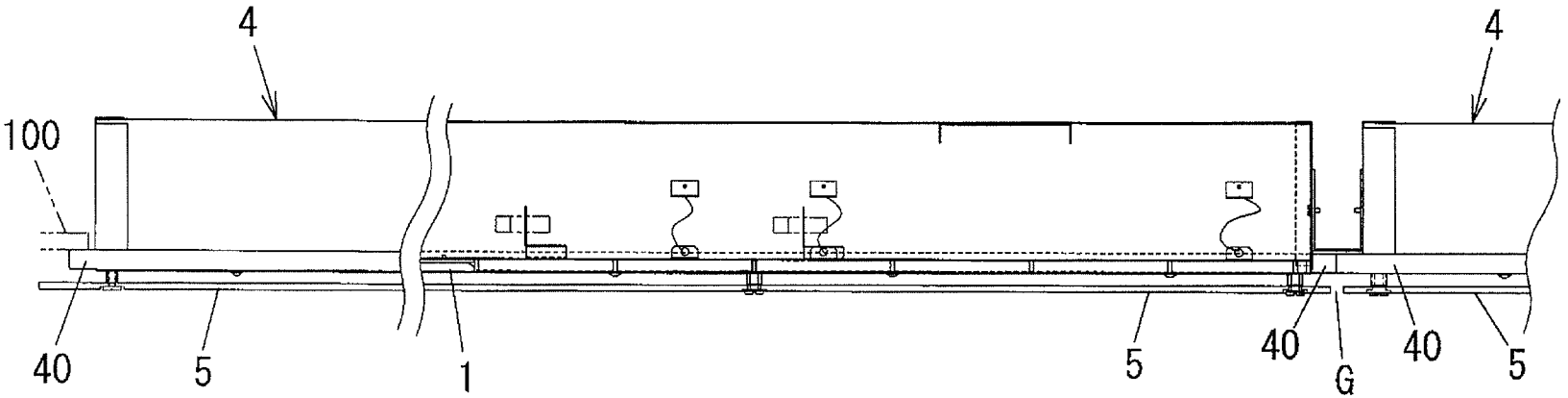
FIG. 2 is a side view of the lighting device of the first embodiment kept in an embedded state.
Figure 3:
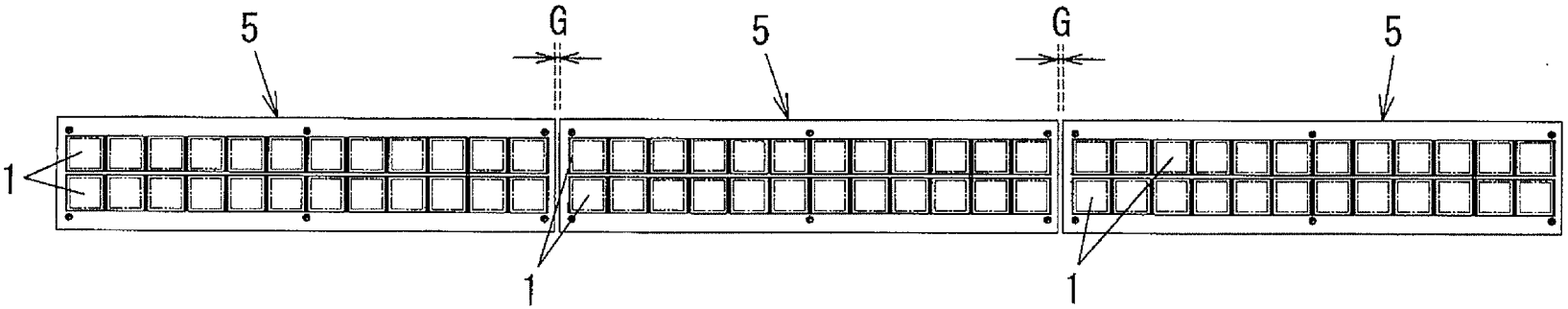
FIG. 3 is a bottom view of the lighting device of the first embodiment kept in an embedded state.

It is sometimes the case that a plurality of lighting devices is embedded in the ceiling in an end-to-end relationship along the longitudinal direction as shown in FIGS. 2 and 3. In that case, as shown in FIG. 2, the device bodies 4 of the adjoining lighting devices are arranged so that the frame portions 40 of the device bodies 4 can make contact with each other. However, the longitudinal dimension of the cover 5 may possibly be changed due to thermal expansion. It is therefore preferred that, as shown in FIG. 2, a gap G exists between the covers 5 of the adjoining lighting devices.

Figure 4A:
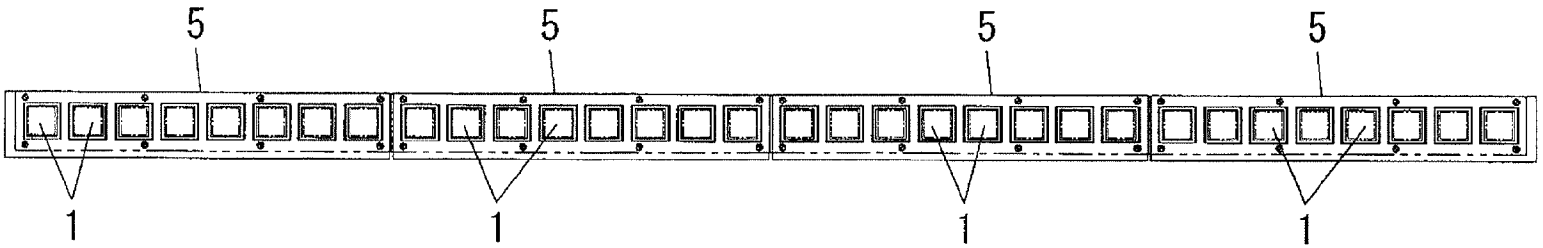
FIGS. 4A and 4B are bottom and side views showing a modified example of the lighting device of the first embodiment.
Figure 4B:
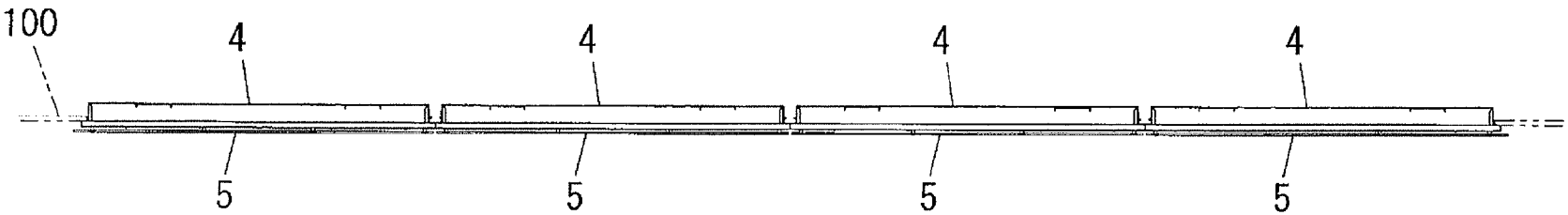

The surface light-emitting modules 1 need not be necessarily held in two rows along the longitudinal direction with respect to the device body 4. For example, as shown in FIGS. 4A and 4B, a plurality of (eight, in the illustrated example) surface light-emitting modules 1 may be held in a single row along the longitudinal direction with respect to the device body 4.

In order to make the boundary between the light-emitting surfaces of the surface light-emitting modules 1 and the non-light-emitting regions hardly visible, it is preferred that the transverse and longitudinal dimensions of the cover 5 are larger than the transverse and longitudinal dimensions of the open surface (the lower surface) of the device body 4. If the protruding dimension of the cover 5 is set small at the wall side (at the upper side in FIG. 4A), it becomes possible to attach the lighting device to the ceiling in a position close to a wall.

(Second Embodiment)

Figure 5A:
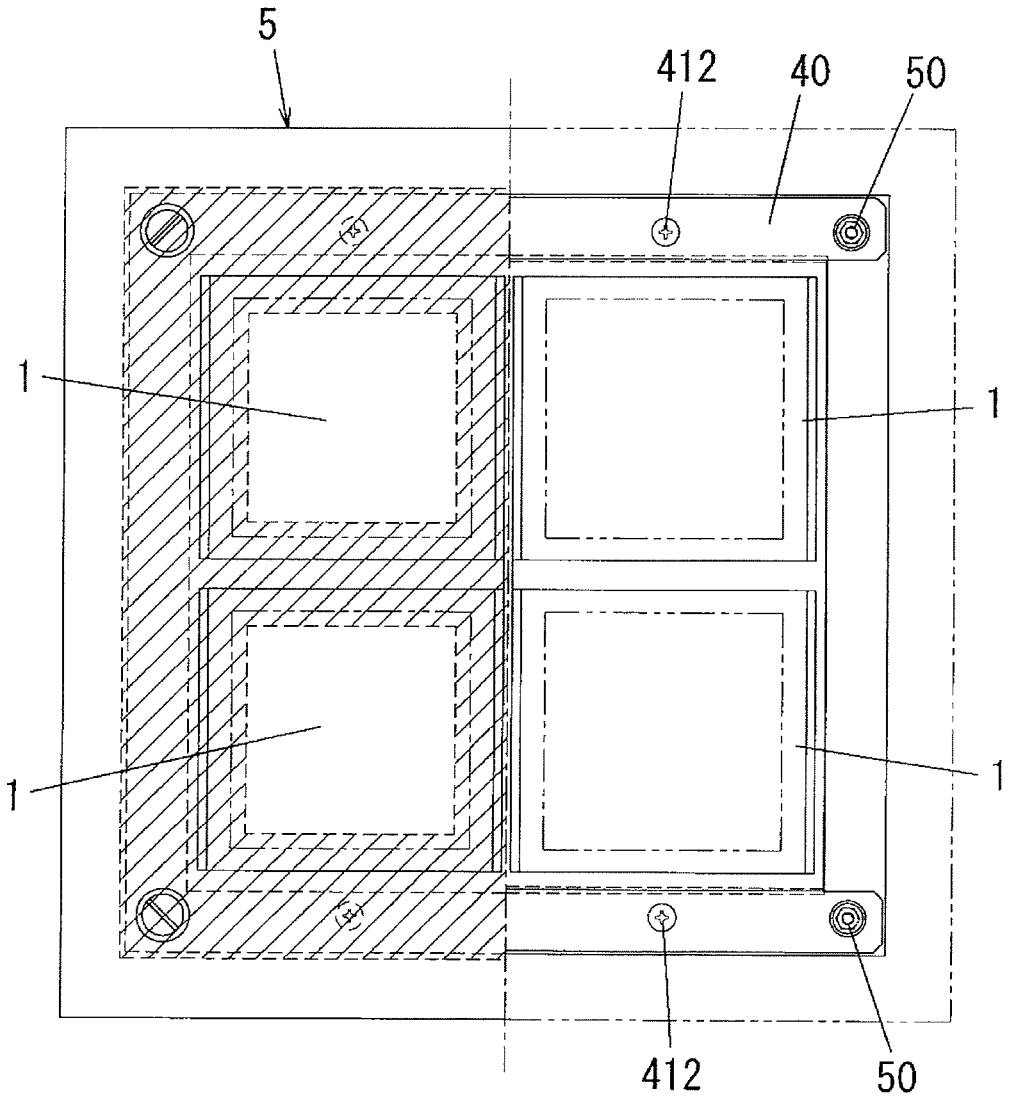
FIGS. 5A and 5B are bottom and side views showing a lighting device according to a second embodiment of the present invention.
Figure 5B:
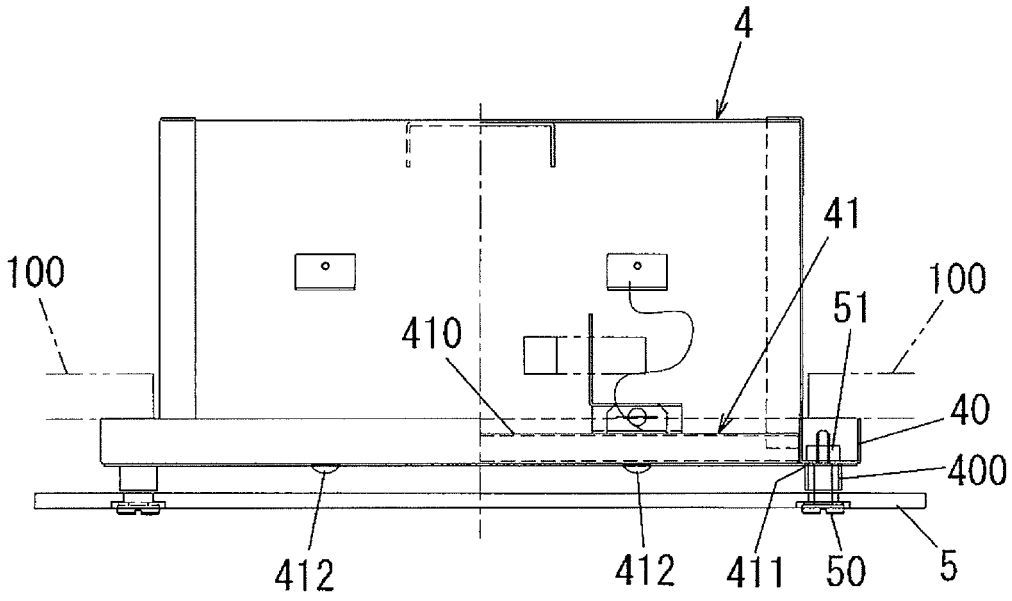

As shown in FIGS. 5A and 5B, the lighting device of the present embodiment is characterized by the shape of the device body 4. Other configurations than the shape of the device body 4 remain the same as the configurations of the first embodiment. Therefore, the components differing in shape but identical in function will be designated by the same reference symbols as used in the first embodiment and will not be described in detail.

Referring to FIGS. 5A and 5B, the device body 4 of the lighting device of the present embodiment is formed into a rectangular box-like shape to have a square open lower surface. Four surface light-emitting modules 1 are attached to the attachment plate 41, two in the transverse direction and two in the longitudinal direction. A space (gap) is provided between the two surface light-emitting modules 1 arranged along the up-down direction in FIG. 5A. The space allows the light-emitting units 2 to slide with respect to the base units 3 when the light-emitting units 2 are mounted to the base units 3.

In the present embodiment, the cover 5 is arranged at the side of the lower surface of the device body 4. Thus the light-emitting units 2 are hard to drop from the base units 3. As shown in FIG. 5A, the hatched region of the front surface of the cover 5 is coated with paint or formed to have irregularities, thereby reducing the light transmittance. Accordingly, the boundary between the light-emitting surfaces and the non-light-emitting regions is hardly visible. This makes it possible to ameliorate the outward appearance of the lighting device.

(Third Embodiment)

Figure 6A:
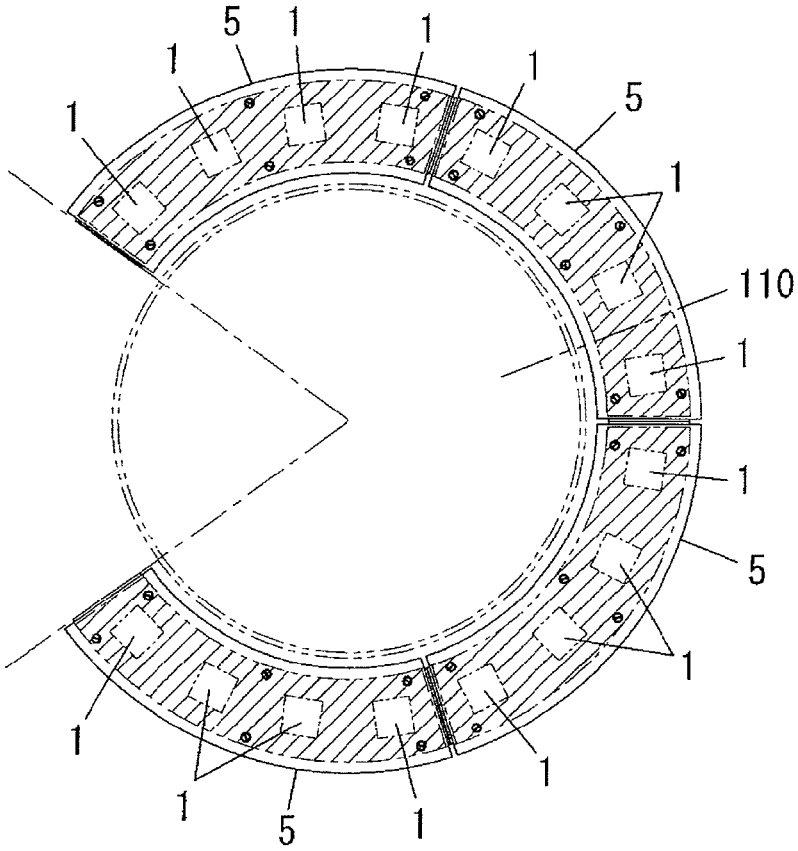
Figure 6B:
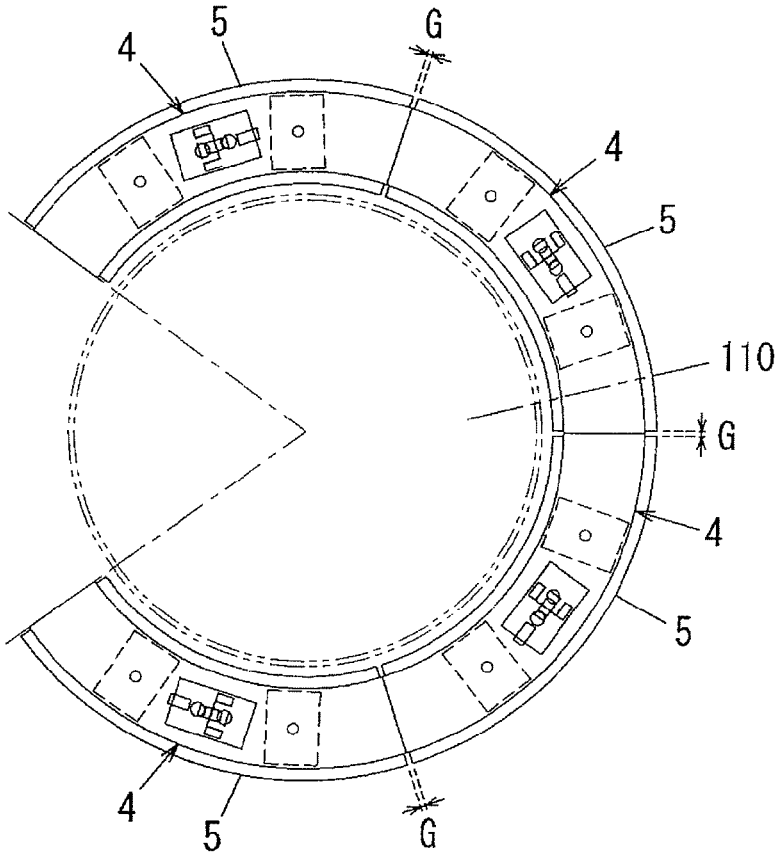

As shown in FIGS. 6A and 6B, the lighting device of the present embodiment is characterized by the shape of the device body 4. Other configurations than the shape of the device body 4 remain the same as the configurations of the first embodiment. Therefore, the components differing in shape but identical in function will be designated by the same reference symbols as used in the first embodiment and will not be described in detail.

Referring to FIGS. 6A and 6B, the device body 4 of the lighting device of the present embodiment is formed into a box-like shape curved in an arc shape along the longitudinal direction. Four surface light-emitting modules 1 are attached to the attachment plate 41 at a regular interval along the circumferential direction.

The lighting device of the present embodiment is embedded in the ceiling in such a fashion as to surround, e.g., a cylindrical pillar 110. While four lighting devices are arranged along the circumferential direction in the example shown in FIGS. 6A and 6B, an arbitrary number of lighting devices, e.g., one to five lighting devices, can be installed depending on the conditions of an installation place.

In the present embodiment, the cover 5 is arranged at the side of the lower surface of the device body 4. Thus the light-emitting units 2 are hard to drop from the base units 3. As shown in FIG. 6A, the hatched region of the front surface of the cover 5 is coated with paint or formed to have irregularities, thereby reducing the light transmittance. Accordingly, the boundary between the light-emitting surfaces and the non-light-emitting regions is hardly visible. This helps ameliorate the outward appearance of the lighting device. A gap G is provided between the covers 5 of the adjoining lighting devices.

(Fourth Embodiment)

The lighting devices of the first to third embodiments are embedded in the ceiling. In contrast, the lighting device of the present embodiment is a bracket-type lighting device attached to a wall. The components differing in shape but identical in function will be designated by the same reference symbols as used in the first embodiment and will not be described in detail.

Figure 7:
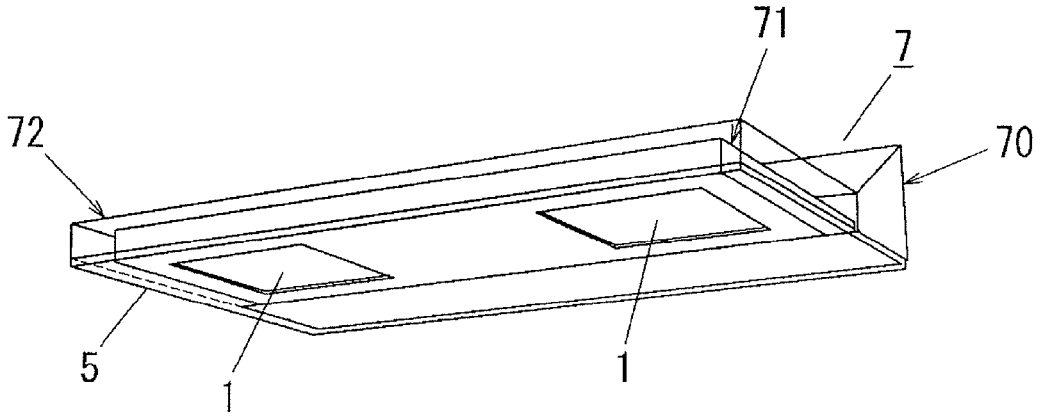
FIG. 7 is a perspective view showing a lighting device according to a fourth embodiment of the present invention.
Figure 8A:
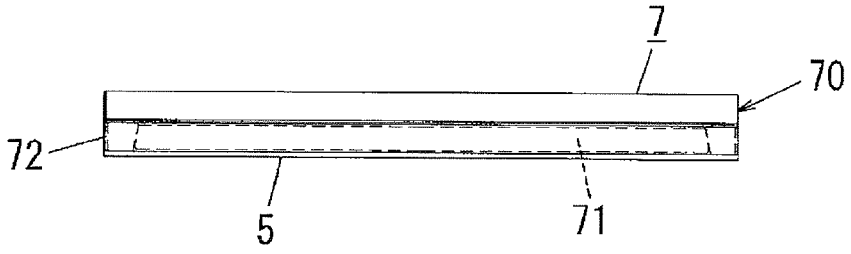
FIGS. 8A, 8B and 8C are front, top and bottom views of the lighting device according to the fourth embodiment.
Figure 8B:
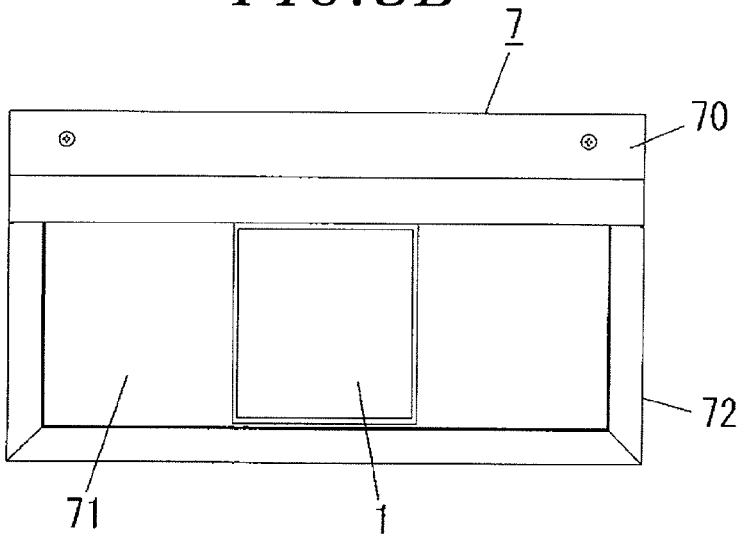
Figure 8C:
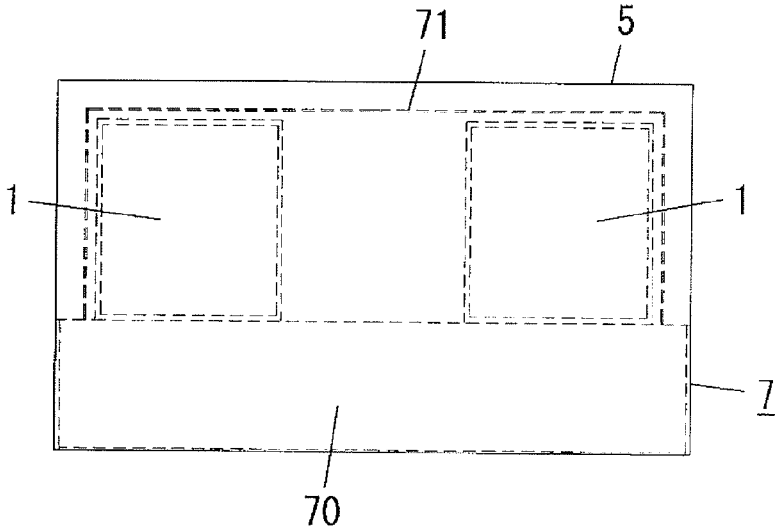

As shown in FIGS. 7 to 8C, the lighting device of the present embodiment includes a device body 7, three surface light-emitting modules 1, a cover 5 and so forth. The device body 7 includes a body portion 70 attached to a wall, a holder portion 71 for holding the surface light-emitting modules 1 in place and a transparent cover 72 for covering the peripheral region of the holder portion 71.

The body portion 70 is formed into a substantially rectangular columnar shape to have a trapezoidal bottom surface. The side surface of the body portion 70 having a largest area is attached to a wall. The holder portion 71 is formed into a flat rectangular box-like shape. The lateral end surface of the holder portion 71 extending in the longitudinal direction is coupled to the body portion 70. In other words, the holder portion 71 protrudes forward from the body portion 70 attached to a wall, such that the thickness direction of the holder portion 71 extends in the up-down direction (see FIG. 7).

The holder portion 71 holds three surface light-emitting modules 1 arranged side by side along the longitudinal direction (the left-right direction in FIGS. 8A to 8C). For example, the two surface light-emitting modules arranged at the opposite ends are held such that the light-emitting surfaces thereof face downward. The surface light-emitting module 1 arranged at the center is held such that the light-emitting surface thereof faces upward.

The transparent cover 72 is made of a light-transmitting synthetic resin such as an acryl resin or the like and is arranged so as to surround the periphery of the holder unit 71 as shown in FIG. 8B.

The cover 5 is made of a light-transmitting synthetic resin such as an acryl resin or the like and is formed into a rectangular plate-like shape. The cover 5 is attached to the lower surface of the device body 7.

In the present embodiment, the cover 5 is arranged at the side of the lower surface of the device body 7. Thus the light-emitting units 2 of the surface light-emitting modules 1 are hard to drop from the base units 3.

While the invention has been shown and described with respect to the embodiments, it will be understood by those skilled in the art that various changes and modification may be made without departing from the scope of the invention as defined in the following claims.

What is claimed is:

1. A lighting device, comprising:

a device body attached to an installation surface:

one or more surface light-emitting modules held in the device body; and a cover attached to the device body in an opposing relationship with a light-emitting surface of each of the one or more surface light-emitting modules, wherein each of the one or more surface light-emitting modules includes a light-emitting unit having a light-emitting body and a base unit fixed to the device body and configured to removably hold the light-emitting unit by an elastic force, and at least portions of the cover facing light-emitting surfaces of the one or more surface light-emitting modules are made of a light-transmitting material, the cover being attached to the device body by a force stronger than the elastic force wherein the device body includes a frame portion, the frame portion having an L-shaped cross-sectional shape formed along the entire circumference of an end portion of the device body, and wherein the cover is attached to the device body in a spaced-apart relationship with the device body and the light-emitting surfaces such that a portion of the light emitted from the one or more surface light-emitting modules is repeatedly reflected between the cover and the light-emitting surfaces.

2. The lighting device of claim 1, wherein the one or more surface light-emitting modules are at least two in number and the at least two surface light-emitting modules are held in the device body such that the light-emitting surfaces are arranged with a gap between every two neighboring light-emitting modules, the cover being formed such that a region corresponding to the gap has a light transmittance smaller than that of a region corresponding to the light-emitting surfaces.

3. The lighting device of claim 1, further comprising bosses that protrude from the frame portion, and wherein the bosses attach the cover to the device body in a spaced-apart relationship with the device body and the light-emitting surfaces.

* * * * *